US010345743B2

(12) United States Patent
Takase et al.

(10) Patent No.: US 10,345,743 B2
(45) **Date of Patent: *Jul. 9, 2019**

(54) IMAGE FORMING APPARATUS WITH VIBRATION CONTROLLING MEMBER

(71) Applicant: CANON KABUSHIKI KAISHA, Tokyo (JP)

(72) Inventors: Kazuki Takase, Mishima (JP); Joji Goto, Susono (JP); Yoshimi Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/019,934

(22) Filed: Jun. 27, 2018

(65) Prior Publication Data

US 2018/0314192 A1 Nov. 1, 2018

Related U.S. Application Data

(62) Division of application No. 14/955,737, filed on Dec. 1, 2015, now Pat. No. 10,042,289.

(30) Foreign Application Priority Data

Dec. 2, 2014 (JP) ..... 2014-244530

(51) Int. Cl.
*G03G 15/16* (2006.01)
*G03G 21/16* (2006.01)
(Continued)

(52) U.S. Cl.
CPC ..... *G03G 15/161* (2013.01); *G03G 15/168* (2013.01); *G03G 21/007* (2013.01);
(Continued)

(58) Field of Classification Search
CPC ..... G03G 15/161; G03G 15/168; G03G 21/0011; G03G 21/0029; G03G 21/007;
(Continued)

(56) References Cited

U.S. PATENT DOCUMENTS 4,152,067 A 5/1979 Kubota
4,470,689 A 9/1984 Nomura et al.
(Continued)

FOREIGN PATENT DOCUMENTS

JP S53-082419 A 7/1978
JP 2002-244521 A 8/2002
(Continued)

OTHER PUBLICATIONS

Office Action dated Jul. 3, 2018, in Japanese Patent Application No. 2014-244530.

(Continued)

*Primary Examiner* — Joseph S Wong
(74) *Attorney, Agent, or Firm* — Venable LLP

(57) ABSTRACT

An image forming apparatus includes an image bearing member configured to carry a toner image; a cleaning member contacted to the image bearing member to clean a surface of the image bearing member by movement of the surface of the image bearing member: a supporting member configured to support the cleaning member; a case provided with a space configured to hold the supporting member therein; a viscoelasticity member; and a vibration controlling member configured to suppress vibration of the cleaning member, wherein the vibration controlling member is mounted on an outer surface of the case by the viscoelasticity member.

14 Claims, 7 Drawing Sheets

(51) Int. Cl.
*G03G 21/00* (2006.01)
*G03G 21/10* (2006.01)

(52) U.S. Cl.
CPC ..... *G03G 21/0011* (2013.01); *G03G 21/0029* (2013.01); *G03G 21/10* (2013.01); *G03G 21/169* (2013.01); *G03G 2215/1661* (2013.01)

(58) Field of Classification Search
CPC ..... G03G 21/10; G03G 21/169; G03G 2215/1661
See application file for complete search history.

(56) References Cited

U.S. PATENT DOCUMENTS

| | | | | |
|---|---|---|---|---|
| 5,565,961 | A | 10/1996 | Shoji et al. | |
| 6,083,588 | A | 7/2000 | Kagawa et al. | |
| 8,565,661 | B2 | 10/2013 | Okamoto et al. | |
| 8,718,531 | B2 | 5/2014 | Ichikawa et al. | |
| 8,862,018 | B2 | 10/2014 | Suzuki et al. | |
| 10,042,289 | B2 * | 8/2018 | Takase | G03G 15/161 |
| 2005/0100374 | A1 | 5/2005 | Satoh et al. | |
| 2010/0061780 | A1 * | 3/2010 | Sugiyama | G03G 21/0029 399/350 |
| 2010/0247189 | A1 | 9/2010 | Akamatsu et al. | |
| 2011/0052286 | A1 * | 3/2011 | Urayama | G03G 21/0029 399/346 |
| 2012/0076559 | A1 | 3/2012 | Kimura et al. | |
| 2012/0082495 | A1 | 4/2012 | Ichiwawa et al. | |
| 2012/0114404 | A1 | 5/2012 | Ichikawa et al. | |
| 2013/0195485 | A1 * | 8/2013 | Ueno | G03G 15/161 399/53 |
| 2015/0277298 | A1 | 10/2015 | Suzuki et al. | |

FOREIGN PATENT DOCUMENTS

| | | | |
|---|---|---|---|
| JP | 2005-148257 | A | 6/2005 |
| JP | 2006-106017 | A | 4/2006 |
| JP | 2009-042496 | A | 2/2009 |
| JP | 2009-069799 | A | 4/2009 |
| JP | 2009-098503 | A | 5/2009 |
| JP | 2009-116161 | A | 5/2009 |
| JP | 2009-300601 | A | 12/2009 |
| JP | 2010-072524 | A | 4/2010 |
| JP | 2010-128400 | A | 6/2010 |
| JP | 2010-230930 | A | 10/2010 |
| JP | 2012-068445 | A | 4/2012 |
| JP | 2012-093682 | A | 5/2012 |
| JP | 2012-098616 | A | 5/2012 |
| JP | 2014-126619 | A | 7/2014 |

OTHER PUBLICATIONS

Office Action dated Dec. 18, 2018, in Japanese Patent Application No. 2014-244530.

* cited by examiner

IMAGE FORMING APPARATUS WITH VIBRATION CONTROLLING MEMBER

This is a divisional of U.S. patent application Ser. No. 14/955,737, filed Dec. 1, 2015.

FIELD OF THE INVENTION AND RELATED ART

The present invention relates to an image forming apparatus which uses an electrophotographic or electrostatic recording method. In particular, it relates to an image forming apparatus having a cleaning component which rubs the surface of an image bearing component such as an intermediary transferring component, by being placed in contact with the image bearing component to clean the image bearing component.

Generally speaking, an image forming operation carried out by an image forming apparatus which uses an electrophotographic image forming method or an electrostatic recording method is as follows. To begin with, a toner image is formed on an image bearing component such as an electrostatically recordable dielectric component and an intermediary transferring component, with the use of an optional image forming process. This toner image is transferred onto a transfer medium such as paper, and then, is fixed to the transfer medium by the application of heat and pressure to the recording medium and the toner image thereon. By the way, a transfer medium bearing component which bears and conveys the transfer medium onto which a toner image is transferred from an image bearing component such as a photosensitive component is sometimes used as an image bearing component.

As a cleaning method, more concretely, a method for removing adherents such as residual toner from the surface of the movable components, such as the photosensitive component, electrostatically recordable dielectric component, intermediary transferring component, etc., of an image forming apparatus such as the one described above, a method which places a cleaning component, such as a blade, in contact with the surface of the movable component, has been widely used. As the blade, a rubber blade is prevalently in use. In reality, a very small amount of toner slips through the small gaps which are present between the movable component and blade. As the residual toner slips through the gaps, it lubricates between the blade and movable component, keeping thereby the cleaning device in cleaning performance.

However, in recent years, there has been a substantial amount of improvement in blade material. With the improvement in the quality of the material for a blade, the blade has been improved in cleaning performance. Thus, a cleaning device has been reduced in the amount by which the residual toner is allowed to slip through the gaps between the blade and movable component, as lubricant. Therefore, a cleaning device has been increased in the amount of "stiction" between the blade and movable component. In some cases, therefore, low-frequency vibration is incessantly generated by the blade. As the low-frequency vibration occur, the components, such as a piece of metallic plate, by which the blade is supported, resonates with the low-frequency vibration, generating thereby strange noises (which hereafter will be referred to as "blade noise") which are annoying to a user of the apparatus.

One of the methods to deal with this blade noise is proposed in Japanese Laid-open Patent Application No. 2005-148257. Referring to FIG. 9, according to this application, a first vibration controlling component 225*a* and a second vibration controlling component 225*b* are attached to a supportive component by which the blade 220 is supported, in order to dampen the vibrations. The first vibration controlling component is pasted to the supportive component 221 to increase the supportive component 221 in mass and rigidity, whereas the second vibration controlling component 225*b* is pasted to the opposite surface of supportive component 221 from the blade 220, with the use of viscoelastic material.

In some cases, however, it is difficult to attach a vibration controlling component to the blade supporting component of a cleaning device, because it has been desired to reduce an image forming apparatus in size. In addition, an attempt to paste two vibration controlling components to the blade supporting component will sometimes result in increase in the size of the cleaning device.

SUMMARY OF THE INVENTION

Therefore, the primary object of the present invention is to provide an image forming apparatus having a cleaning device which does not suffer from the noises attributable to the low-frequency vibration of the cleaning component of the cleaning device, and yet, is no larger than a conventional cleaning device.

According to an aspect of the present invention, there is provided an image forming apparatus comprising an image bearing member configured to carry a toner image; a cleaning member contacted to said image bearing member to clean a surface of said image bearing member by movement of the surface of said image bearing member: a supporting member configured to support said cleaning member; a case provided with a space configured to hold said supporting member therein; a viscoelasticity member; and a vibration controlling member configured to suppress vibration of said cleaning member, wherein said vibration controlling member is mounted on an outer surface of said case by said viscoelasticity member.

Further features of the present invention will become apparent from the following description of exemplary embodiments with reference to the attached drawings.

Figure 8:
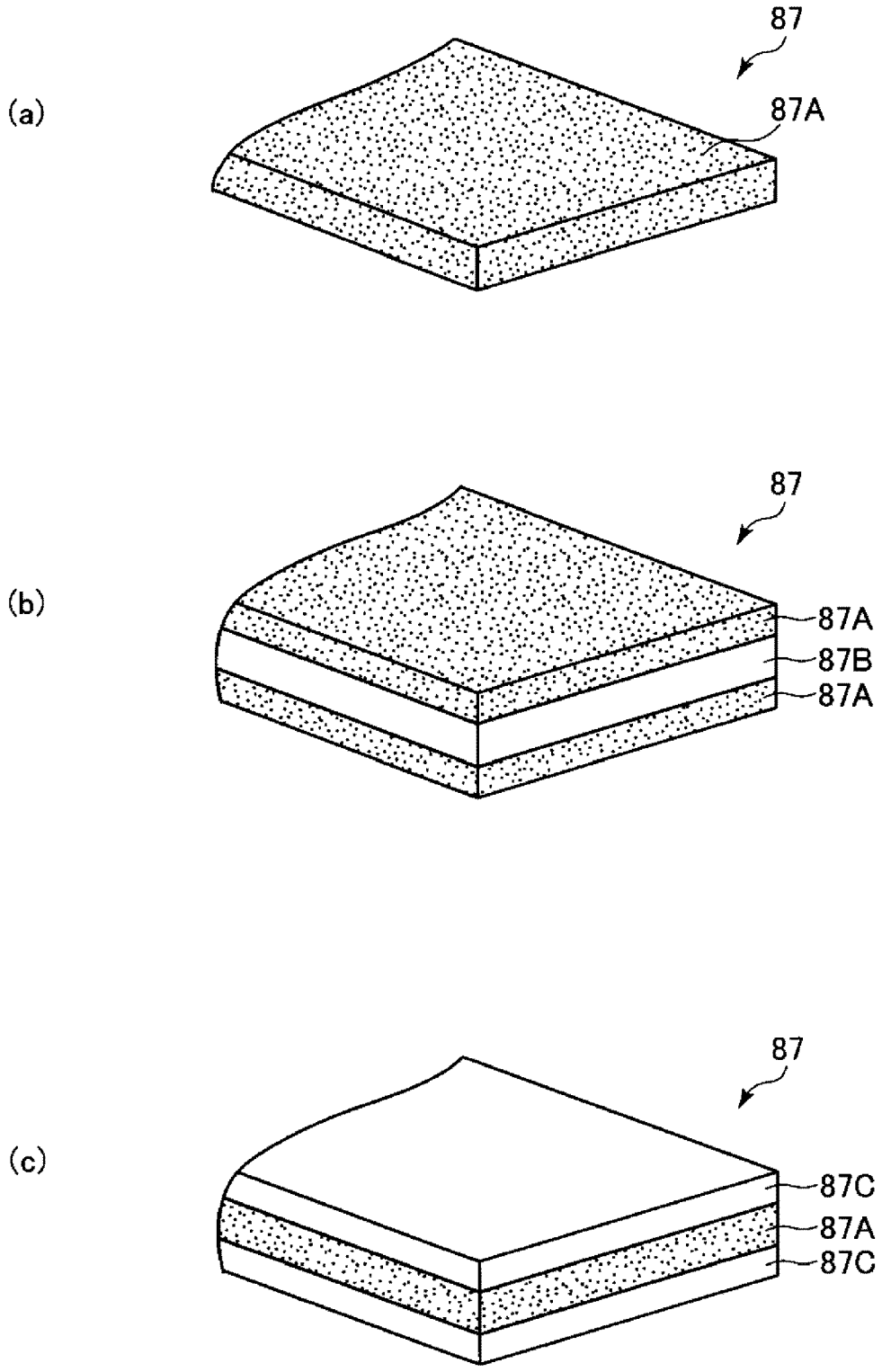

Parts (a), (b) and (c) of FIG. 8 are schematic views of examples of the viscoelastic material.

Figure 9:
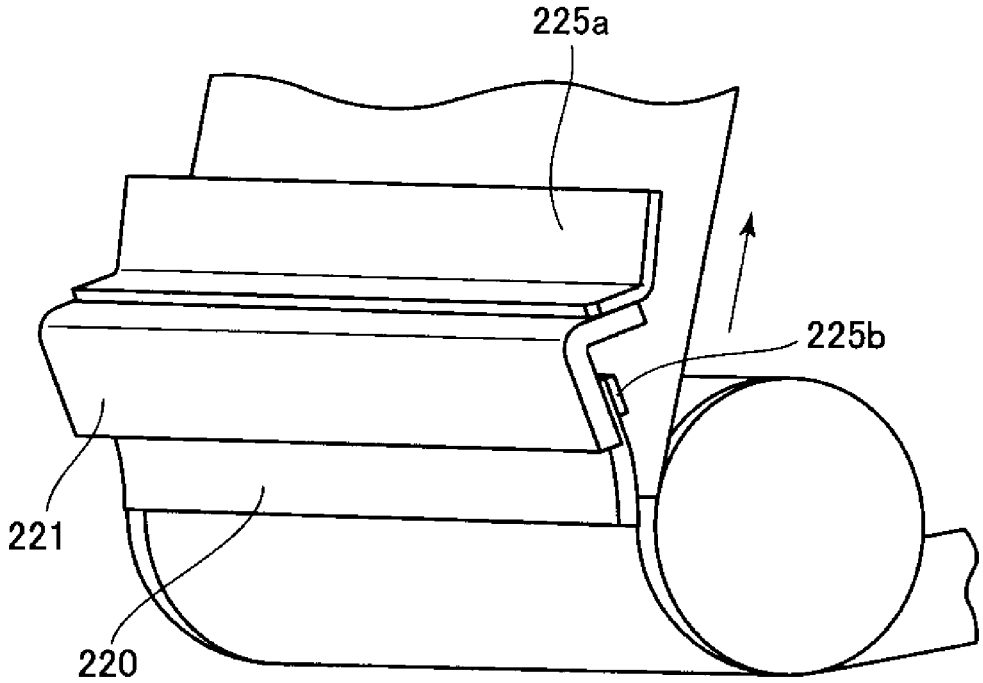

FIG. 9 is a perspective view of an example of a cleaning device.

DESCRIPTION OF THE EMBODIMENTS

Hereinafter, image forming apparatuses which are in accordance with the present invention are described in detail with reference to appended drawings.

Embodiment 1

1. General Structure and Operation of Image Forming Apparatus

Figure 1:
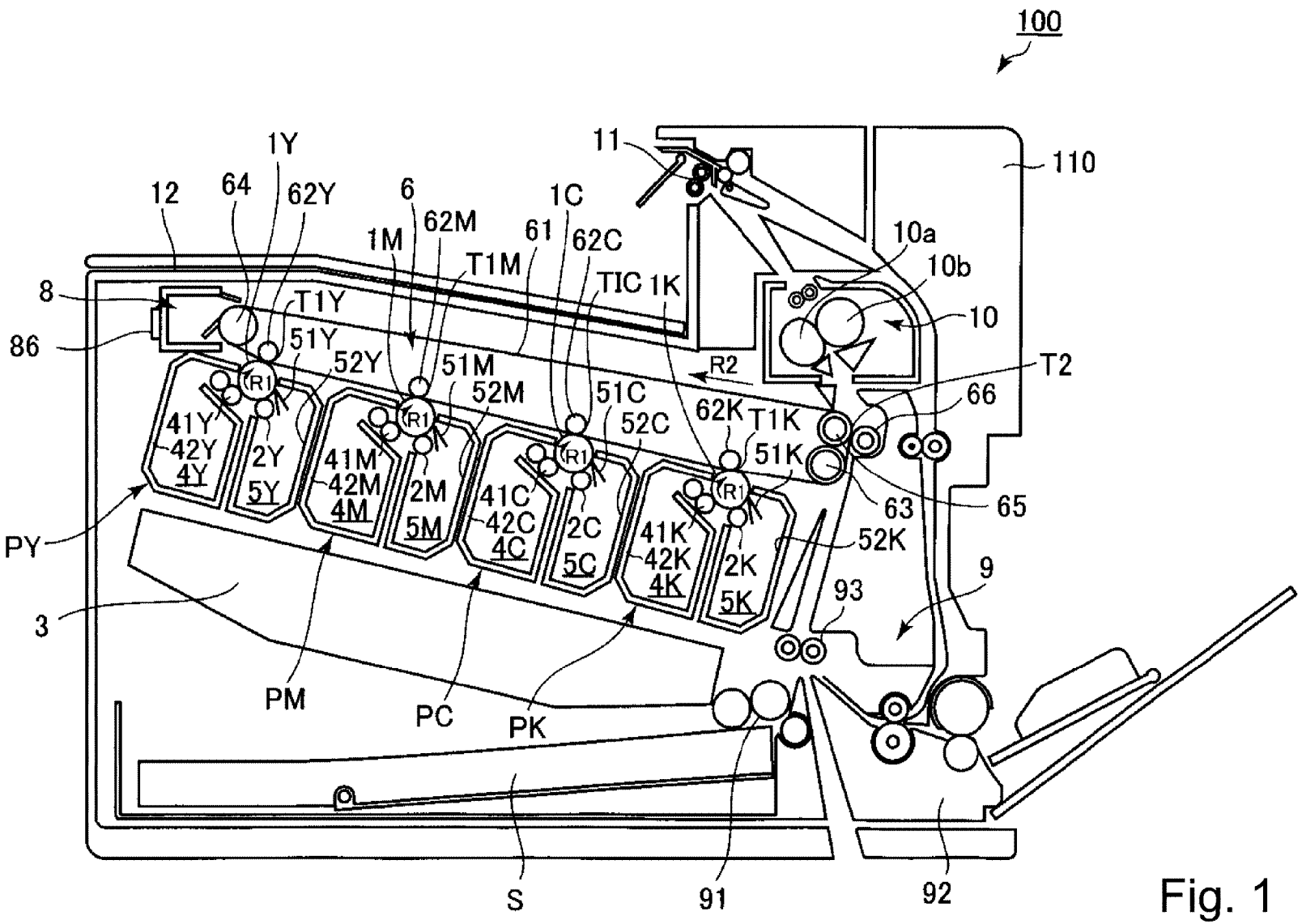
FIG. 1 is a schematic sectional view of the image forming apparatus in the first embodiment of the present invention.

FIG. 1 is a vertical sectional view of the image forming apparatus in the first embodiment of the present invention. The image forming apparatus 100 in this embodiment is capable of forming full-color images with the use of an electrophotographic image forming method. More specifically, it is a laser beam printer of the so-called tandem type (four drum type), and also, of the so-called intermediary transfer type.

The image forming apparatus 100 has multiple image forming sections, more specifically, the first, second, third, and fourth cartridges PY, PM, PC and PK, which form yellow (Y), magenta (M), cyan (C) and black (K) images, respectively. On the underside of these process cartridges PY, PM, PC and PK, a laser scanner 3, as an exposing means, are disposed. Further, on the topside of the process cartridges PY, PM, PC and PK, an intermediary transfer unit 6 is disposed, which is for transferring the toner images formed in the process cartridge PY, PM, PC and PK, onto a sheet S of transfer medium.

By the way, in a case where the components with which the image forming apparatus 100 is provided, to form images, different in color, and which are practically the same in structure and function, the suffixes Y, M, C and K which indicate the color of monochromatic toner images they form are not shown, unless they need to be shown for specific reasons, so that they can be described together.

Each process cartridge P has a photosensitive drum 1, which is an electrophotographic photosensitive component, as an image bearing component, which is in the form of a drum (cylindrical) and is rotatable. The process cartridge P has also various drum processing means, more specifically, a charge roller 2 as a charging means which is in the form of a roller, a developing device 4 as a developing means, and a drum cleaning device 5 as a photosensitive component cleaning means. These drum processing means are unitized in the form of a cartridge (process cartridge) so that they can be removably installed in the main assembly 110 of the image forming apparatus 100.

The photosensitive drum 1 is rotationally driven in the direction indicated by an arrow mark R1 in the drawing at a preset peripheral velocity by a combination of an unshown driving force source and drive train. As the photosensitive drum 1 is rotated, the peripheral surface of the photosensitive drum 1 is uniformly charged by the charge roller 2 to preset polarity (negative in this embodiment) and polarity level. During the charging of the photosensitive drum 1, a preset charge voltage (charge bias) is applied to the charge roller 2. Then, the uniformly charged portion of the peripheral surface of the photosensitive drum 1 is scanned by (exposed to) a beam of laser light emitted from the laser scanner 3 in accordance with the information of the images (monochromatic images to which image to be formed has been separated). As a result, an electrostatic latent image (electrostatic image) is formed on the peripheral surface of the photosensitive drum 1. This electrostatic latent image formed on the peripheral surface of the photosensitive drum 1 is developed into a toner image (image formed of toner) by the developing device 4, which uses toner as developer. The toner is stored in the developer container 42 of the developing device 4. During the development, preset development voltage (development bias) is applied to the development roller 41 of the developing device 4. In this embodiment, the electrostatic latent image is reversely developed. More concretely, as the peripheral surface of the photosensitive drum 1 is uniformly charged, and exposed, the exposed points of the peripheral surface of the photosensitive drum 1 reduce in potential, in terms of absolute value. Then, toner charged to the same polarity as the polarity to which the photosensitive drum 1 is charged is adhered to these points having reduced in potential level, effecting thereby a toner image.

The intermediary transfer unit 6 has an intermediary transfer belt 61, as an intermediary transferring component which is disposed so that it opposes the four photosensitive drums 1Y, 1M, 1C and 1K. The intermediary transfer belt 61 is an example of movable component employed by the image forming apparatus 100. The intermediary transfer belt 61 is wrapped around a combination of multiple belt suspending-tensioning rollers, more specifically, a driver roller 63, a tension roller 64, and belt backing roller 65 (which opposes secondary transfer roller). As the driver roller 63 is rotationally driven by an unshown combination of a driving force source and a drive train, the driving force is transmitted to the intermediary transfer belt 61. Thus, intermediary transfer belt 61 rotates (circularly moves) in the direction indicated by an arrow mark R2 in the drawing at a preset speed (peripheral velocity). Further, the image forming apparatus 100 is provided with primary transfer rollers 62Y, 62M, 62C and 62K, as primary transferring means, which are the primary transferring components shaped like a roller. The primary transfer rollers 62 are disposed on the inward side of the loop (belt loop) which the intermediary transfer belt 61 forms. Each primary transfer roller 62 is kept pressed toward the photosensitive drum 1 with the presence of the intermediary transfer belt 61 between itself and photosensitive drum 1, forming thereby the primary transferring section T1 (primary transfer nip), which is the area of contact between the intermediary transfer belt 61 and photosensitive drum 1. Moreover, the image forming apparatus 100 is provided with a secondary transfer roller 66 as the secondary transferring means which also is in the form of a roller. The secondary transfer roller 66 is disposed on the outward side of the belt loop in such a manner that it opposes the belt backing roller 65. The secondary transfer roller 66 is kept pressed against the belt-backing roller 66 with the presence of the intermediary transfer belt 61 between itself and the belt-backing roller 66, forming thereby a secondary transferring section T2 (secondary transfer nip) in which the intermediary transfer belt 61 contacts the secondary transfer roller 66.

The toner image formed on the photosensitive drum 1 is transferred (primary transfer) onto the intermediary transfer belt 61 by the function of the primary transfer roller 62, in the primary transferring section T1. During this transfer of the toner image, a preset primary transfer voltage (primary transfer bias), which is DC voltage, is applied to the primary transfer roller 62. The primary transfer voltage is opposite in polarity from the charge (normal charge) which is given to the toner, for development. For example, in an image forming operation for forming a full-color image, four monochromatic toner images which are different in color are formed on the four photosensitive drum 1Y, 1M, 1C and 1K, one for one, and are sequentially transferred in layers onto the intermediary transfer belt 61. Consequently, a full-color image is effected on the intermediary transfer belt 61.

The toner image formed on the intermediary transfer belt 61 is conveyed to the secondary transferring section T2, in which it is transferred (secondary transfer) by the function of the secondary transfer roller 66 onto a sheet S of transfer medium while the sheet S is conveyed through the secondary transferring section T2, remaining sandwiched between the intermediary transfer belt 61 and secondary transfer roller 66. During this transfer, preset secondary transfer voltage (secondary transfer bias) is applied to the secondary transfer roller 66. The secondary transfer voltage is DC voltage, and is opposite in polarity from the voltage of the normal toner charge.

A sheet S of transfer medium such as a sheet of recording paper or plastic is supplied to the secondary transferring section T2 by a sheet feeding-conveying device 9. The sheet feeding-conveying device 9 has: a cassette in which multiple sheets of recording medium are stored in layers; a feeding section 91 which feeds sheets S into the main assembly 110 of the image forming apparatus 100, from the cassette while separating each sheet S from the rest; a manual feeding section 92; a pair of registration rollers 93, which deliver each sheet S to the secondary transferring section T2 with preset timing; etc.

After the transfer of the toner image(s) onto a sheet S of transfer medium, the sheet S is conveyed to a fixing device 10 as a fixing means, and is conveyed through the fixation nip which is the interface between the fixation roller 10*a* and pressure roller 10*b* of the fixing device 10, while remaining pinched between the fixation roller 10*a* and pressure roller 10*b*. While the sheet S is conveyed through the fixation nip, heat and pressure are applied to the sheet S and the toner image thereon. Thus, the toner image is fixed to the surface of the sheet S. Thereafter, the sheet S is conveyed further, and is discharged by a pair of discharge rollers 11, etc., into a tray 12 which is a part of the top surface of the main assembly 110 of the image forming apparatus 100.

Such substances as toner (primary transfer residual toner) which are remaining adhered to the peripheral surface of the photosensitive drum 1 after the primary transfer are removed from the peripheral surface of the photosensitive drum 1, and recovered, by the drum cleaning device 5. More concretely, the drum cleaning device 5 has a cleaning blade 51 as a cleaning component. It scrapes away the adherent residues such as the primary transfer residual toner from the peripheral surface of the photosensitive drum 1, and recovers the residues into its residue container 52. The toner (secondary transfer residual toner) remaining on the surface of the intermediary transfer belt 61 after the secondary transfer is removed from the surface intermediary transfer belt 61 by a belt cleaning device 8 as a means for cleaning the intermediary transfer belt, and is recovered. The structure and operation of the belt cleaning device 8 are described later in detail.

In this embodiment, a combination of the process cartridges PY, PM, PC and PK, primary transfer rollers 62Y, 62M, 62C and 62K, laser scanner 3, etc., makes up an image forming means which forms toner images on the intermediary transfer belt 61. Also in this embodiment, the intermediary transfer unit 6 is removably installable into the apparatus main assembly 110. The intermediary transfer unit 6 comprises: the driver roller 63; tension roller 64; belt-backing roller 65; intermediary transfer belt 61 suspended and kept tensioned by the preceding rollers; primary transfer rollers 62, and belt cleaning device 8.

2. Belt Cleaning Device

Next, the belt cleaning device 8 (which hereafter may be referred to simply as "cleaning device") is described.

Figure 2:
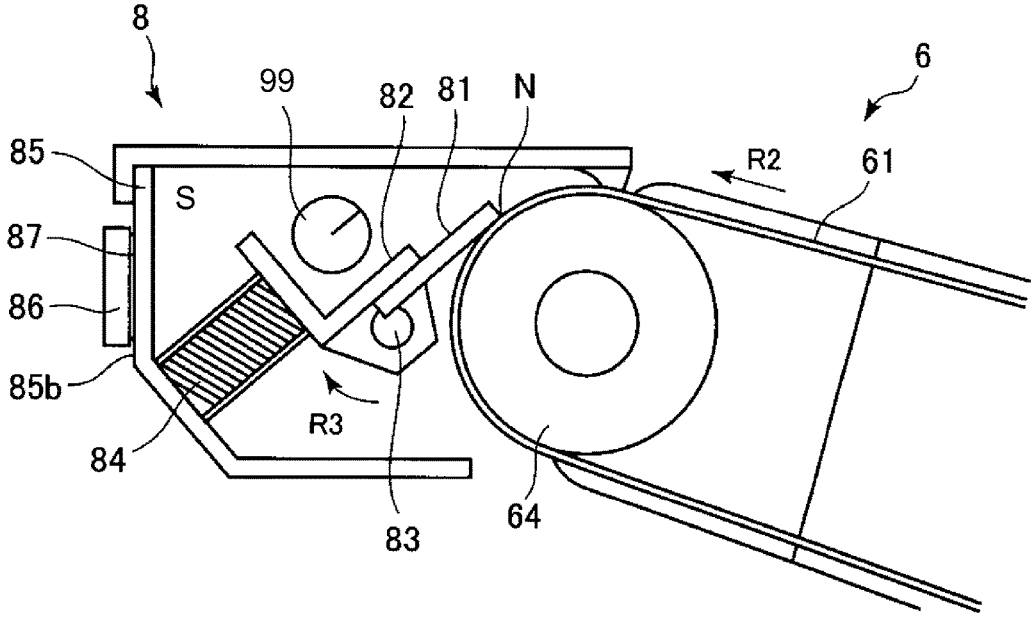
FIG. 2 is a schematic sectional view of the cleaning device in the first embodiment.

FIG. 2 is a sectional view of the cleaning device 8, at a plane which is roughly perpendicular to the widthwise direction (thrust direction) of the intermediary transfer belt 61, that is, the direction which is roughly perpendicular to the moving direction of the surface of the intermediary transfer belt 61. Referring to FIG. 2, the cleaning device 8 has a cleaning blade 81, a blade support 82, a pivot pin 83, a blade pressing spring 84, a housing 85, a screw 99, etc. . . . In terms of the rotational direction of the intermediary transfer belt 61, the cleaning device 8 is disposed so that it cleans the surface of the intermediary transfer belt 61 on the downstream side of the secondary transferring section T2, and upstream side of the primary transferring section T1.

The cleaning blade 81 (which hereafter may be referred to simply as "blade"), which is a cleaning component, is a rubber blade made of elastic rubber. The blade 81 is in the form of a piece of rubber plate having preset length, width, and thickness. It is attached to the blade support 82 so that its long edges are parallel to the widthwise direction of the intermediary transfer belt 61. It is disposed so that its lengthwise direction is parallel to the widthwise direction of the intermediary transfer belt 61. The blade 81 is fixed (adhered) to the blade support 82 by one of the long edge portions. Further, the other long edge portion of the blade 81 is kept in contact with the surface of the intermediary transfer belt 61. More concretely, the blade 81 is kept in contact with the intermediary transfer belt 61 in such an attitude that one of its long edge portions, with which the blade 81 is attached to the blade support 82, is on the upstream side of the other long edge portion, in terms of the moving direction of the intermediary transfer belt 61.

The blade support 82 which supports the blade 81 is supported by the housing 85 having an internal space in which the blade support 82 is disposed. The blade support 82 is held to the housing 85 so that it is allowed to pivotally move about the pivot pin 83 attached to the housing 85.

The axial line of the pivot pin 83 is roughly parallel to the widthwise direction of the intermediary transfer belt 61. The blade support 82 is kept pressed by the blade pressing spring 85, which is a compression spring as a pressing means, so that the blade 81 is made to pivot about the pivot pin 83 in the direction indicated by an arrow mark R3 and remain in contact with the intermediary transfer belt 61. In this embodiment, the blade 81 is pressed toward the tension roller 64 with the presence of the intermediary transfer belt 61 between the blade 81 and tension roller 64. Thus, as the intermediary transfer belt 61 is circularly driven, the blade 81 rubs the surface of the intermediary transfer belt 61, in the belt cleaning section N (cleaning nip) which is the area of contact between the blade 81 and intermediary transfer belt 61, scraping away the adherent residues such as the secondary transfer residual toner on the intermediary transfer belt 61, to clean the surface of the intermediary transfer belt 61.

The housing 85 rotatably supports the blade support 82. More concretely, the blade support 82 is pivotally supported by the pivot pin 83 which is attached to the housing 85. Thus, the housing 85 holds the blade 81 in such a manner that the blade 81 is pivotally movable about the pivot pin 83. Further, the housing 85 holds the blade pressing spring 84 in such a manner that the spring 84 remains compressed between the housing 85 and blade support 82. Further, there is the screw 99 as a conveying component, in the housing 85.

The housing 85 constitutes a container which internally holds the blade 81, blade support 82, pivot pin 83, blade pressing spring 84, and screw 99.

As the adherent residues such as the secondary transfer residual toner are removed from the surface of the intermediary transfer belt 61 by the blade 81, they are temporarily recovered into the housing 85, and then, are conveyed by the screw 99 to an unshown waste toner recovery container.

Figure 3:
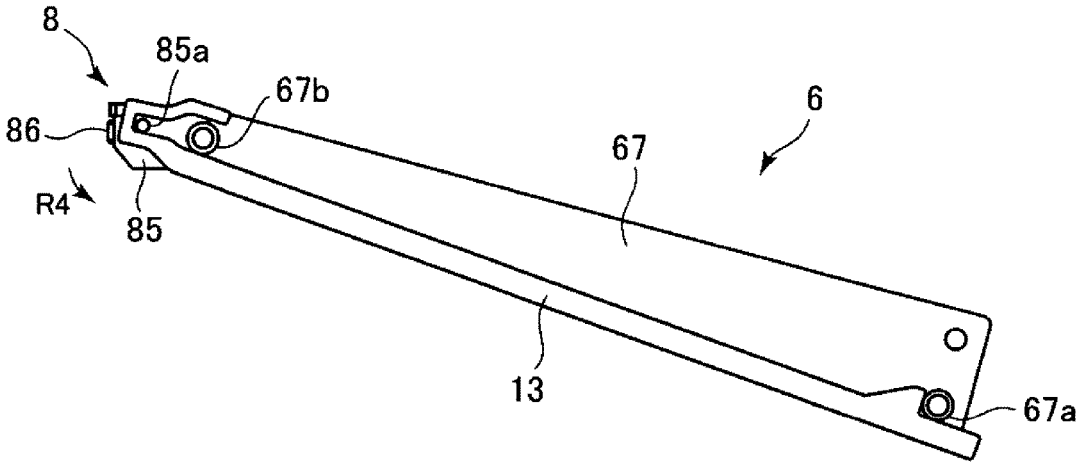
FIG. 3 is a side view of the intermediary transfer unit in the first embodiment.

FIG. 3 is a side view of the intermediary transfer unit 6. Referring to FIG. 3, the intermediary transfer unit 6 has a pair of frames 67, as supporting components, which rotatably support the driver roller 63, tension roller 64, and belt-backing roller 65 in such a manner that the intermediary transfer belt 61 is suspended and kept tensioned by these rollers. Each frame 67 is provided with a positioning boss 67*a*, which protrudes outward from the bottom-right corner of the frame 67, in the widthwise direction of the intermediary transfer belt 61, and the axial line of which roughly coincides with the rotational axis of the driver roller 63. Further, each frame 67 is provided with a frame rotation control boss 67*b*, which protrudes outward in the widthwise direction of the intermediary transfer belt 61 from the left end portion of the frame 67, and the axial line of which roughly coincides with the rotational axis of the tension roller 64. The positioning boss 67*a* of the frame 67 is pressed upon the frame 13 of the apparatus main assembly 110 by an unshown pressing means. Further, the frame rotation control boss 67*b* is kept rested on the frame 13 by the weight of the frame 67. Thus, the frame 67 is held by the apparatus main assembly 110.

The cleaning device 8 is held by the frames 67 so that it is allowed to pivot about the frame rotation control bosses 67*b*. Further, the housing 85 of the cleaning device 8 is provided with a pair of housing rotation control bosses 85*a*, which protrude outward of the housing 85 in the lengthwise direction of the blade 81, from the left end portions of the housing 85, one for one. Thus, as the intermediary transfer belt 61 circularly moves, a certain amount of force is applied to the blade 81 by the intermediary transfer belt 61. This force is transmitted to the housing 85 by way of the blade support 82. Thus, the housing 85 is pressed in the direction indicated by an arrow mark R4 in the drawing, that is, the direction to make the housing 85 rotationally move until the housing rotation control boss 85*a* comes into contact with the frame 13 of the apparatus main assembly 110. As the housing rotation control boss 85*a* comes into contact with the frame 13, the cleaning device 8 is placed in its preset position. In other words, in this embodiment, the positional relationship between the intermediary transfer unit 6 and cleaning device 8 is set by the contact between the positioning boss 85*a* and frame 13. The axial line of the frame rotation control boss 67*b* which functions as the rotation axle of the housing 85 is roughly parallel to the widthwise direction of the intermediary transfer belt 61.

As the intermediary transfer belt 61 circularly moves, the blade 81 is made to slightly vibrate by the intermediary transfer belt 61, in the belt cleaning section N, which is the area of contact between the intermediary transfer belt 61 and blade 81. These vibrations of the blade 81 causes the blade support second conveyance screw 82 to vibrate, and then, spread throughout the cleaning device 8 by way of the pivot pin 83, blade pressing springs 84, and housing 85, generating sometimes strange noises (blade noises). This low-frequency vibration is caused by the circular movement of the intermediary transfer belt 61. That is, the vibration is generated by the operation of the cleaning device 8 itself.

In this embodiment, therefore, a vibration controlling component 86 is attached to the housing 85 with the use of a piece of two-sided adhesive tape 87 as the viscoelastic member. More concretely, the vibration controlling component 86 formed of metallic plate is attached to the outward surface 85*b* of the housing 85, by placing the two-sided adhesive tape 87 in a manner to sandwich the two-sided adhesive tape 87 between the outward surface 85*b* and the vibration controlling component 86. Thus, it is possible to dampen (attenuate) the vibration of the blade support 82.

Figure 4:
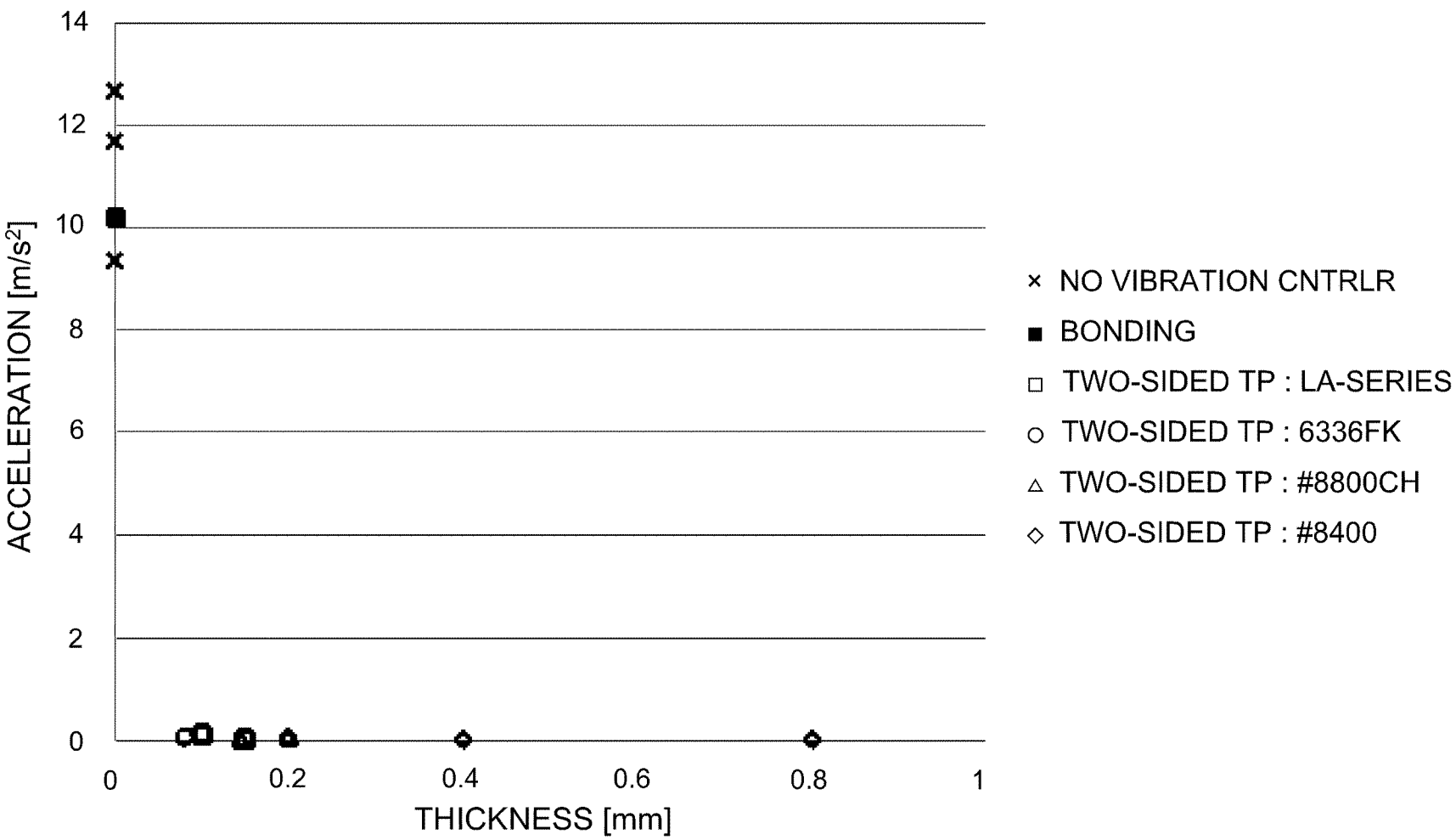
FIG. 4 is a graph which shows the effects of the first embodiment.

The effects of this embodiment are described with reference to FIG. 4 which shows the results of tests. FIG. 4 shows the results of the tests in which multiple vibration controlling components 86 which are the same in shape and weight are attached to multiple housings 85, with the use of multiple adhering means, one for one, and the vibration of the blade support 82 was measured in magnitude for each combination of the vibration controlling component 86 and adhering means. First, the method used to measure the vibration is described. The effectiveness of this embodiment was determined by measuring the vibration of the blade support 82 which supported the blade 81.

In order to measure the vibration, an acceleration pickup which is capable of detecting the vibration was pasted to the blade support 82. Then, the intermediary transfer unit 6 equipped with the blade support 82 to which the acceleration pickup was pasted was installed in the image forming apparatus 100. Then, the vibration which occurred as the intermediary transfer belt 61 was rotated (circularly moved) during an image forming operation was measured. Regarding the environment in which the tests were carried out, an environment which was relatively low in temperature was chosen for the following reason. That is, the blade 81 is formed of rubbery substance. Thus, the lower the temperature, the harder the blade 81 becomes. Thus, the blade 81 is more likely to be made to vibrate at a low frequency when temperature is lower than when temperature is higher.

The method used to attach the vibration controlling component 86 to the housing 85 will be described. In these tests, four different types of two-sided adhesive tape and plain adhesive were used to attach the vibration controlling components 86. The four different types of two-sided adhesive tape 87 were: "LA series (product of Nitto Denko Co., Ltd.) which uses acrylic adhesive; "6336FK" (product of Okamoto Co., Ltd.) which is polyester film sandwiched with silicon adhesive; "Daitak #8800CH" (product of DIC Co., Ltd.) which is made by sandwiching nonwoven fabric with acrylic adhesive; and "Daitak #8400" (product of DIC Co., Ltd.) which is made by sandwiching sheet of foamed substance with acrylic adhesive. As the adhesive, "Aron Alpha" (product of Toagosei Co., Ltd.) was used in this embodiment. It is evident from the results of the tests given in FIG. 4 that in a case where the vibration controlling component 86 was attached to the housing 85 with the use of the two-sided adhesive tape 87, acceleration which indicates the magnitude of vibration was drastically smaller than in a case where the vibration controlling component 86 was attached with the use of adhesive alone. By the way, in a case where the vibration controlling component 86 was attached to the housing 85 with the use of the two-sided adhesive tape 87, the acceleration which indicates the magnitude of the vibrations was also drastically smaller, in comparison with a case in which the vibration controlling component 86 was not attached to the housing 85. Further, in a case where the vibration controlling component 86 was attached to the housing 85 with the use of the two-sided adhesive tape 87, the occurrence of the blade noise attributable to the low-frequency vibration of the blade 81 was virtually impossible to detect. Besides, even if it was detected, it was negligibly small. Moreover, the effects of the vibration controlling component 86 remained the same regardless of the brand and thickness of the two-sided adhesive tape.

In the case where the vibration controlling component 86 attached to the housing 85 with the use of adhesive alone, it vibrated with the housing 85, contributing therefore little to the damping of the vibrations. Therefore, the blade noise attributable to the low-frequency vibration occurred. In comparison, the two-sided adhesive tape 87 has at least a layer of viscoelastic material having a viscoelasticity. Therefore, as the vibration controlling component 86 is attached to the housing 85 through the viscoelastic material, a body of elastic adhesive is placed between the vibration controlling component 86 and housing 85. Thus, the vibration controlling component 86 is allowed to unsympathetically vibrate from the housing 85. Therefore, the vibration of the housing 85 is attenuated. In other words, the vibration which originates from the blade 81 adhered to the blade support 82 is dampened. That is, this embodiment can dampen the low-frequency vibration which comes from the blade 81, and therefore, can prevent the occurrence of the blade noise attributable to the low-frequency vibration of the blade 81.

Here, all that is necessary is that the vibration controlling component 86 is attached to the housing 85 with the placement of a piece of an viscoelastic material between the vibration controlling component 86 and housing 85. In other words, the means for attaching the vibration controlling component 86 to the housing 85 does not need to be the two-sided adhesive tape 87. That is, the means for attaching the vibration controlling component 86 to the housing 85 does not need to have a substrative layer. For example, the vibration controlling component 86 may be attached with the use of adhesive of substantially viscoelastic material layer 87A only (part (a) of FIG. 8), or adhesive materials 87A of the viscoelasticity may be applied on the respective sides of the substrate 87B (part (b) of FIG. 8). These examples are not intended to limit the present invention in scope. Moreover, one example of two-sided adhesive tape which can be used with desirable results is two-sided adhesive tape, the adhesive of which is acrylic. Further, in a case where the two-sided adhesive tape 87 has a substrate, the substrate of the two-sided adhesive tape 87 may be non-woven fabric, plastic film, metallic foil, foamed rubber, or the like. That is, the material for the substrate of the two-sided adhesive tape 87 is optional.

Figure 5:
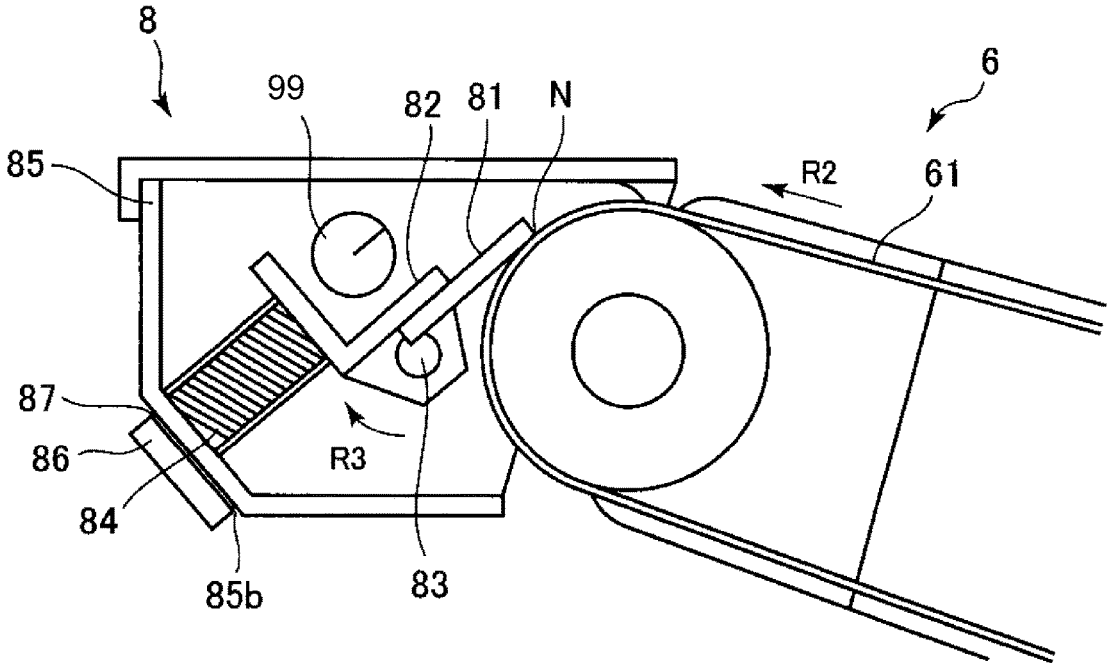
FIG. 5 is a schematic sectional view of a modified version of the cleaning device in the first embodiment, which is different in position of the vibration controlling component from the original version of the cleaning device in the first embodiment.

FIG. 5 is a sectional view of the cleaning device 8 which is different from the cleaning device 8 shown in FIG. 2, in the portion of the housing 85, to which the vibration controlling component 86 is attached. Also in a case where the vibration controlling component 86 was attached as shown in FIG. 5, it was possible to prevent the occurrence of the low-frequency vibration, as in the case where the vibration controlling component 86 was attached as shown in FIG. 2. That is, the tests proved that no matter where on the housing 85 the vibration controlling component 86 was attached, it was possible to prevent the occurrence of the low-frequency vibration. Thus, it is possible to paste the vibration controlling component 86 to the portion of the inward surface of the housing 85, which corresponds to the portion of the outward surface of the housing 85, to which the vibration controlling component 86 was attached as shown in FIG. 2. However, in a case where a space which is available, within the housing 85, for the placement of the vibration controlling component 86, is such that the pasting of the vibration controlling component 86 to the above mentioned portion of the inward surface of the housing 85 places the vibration controlling component 86 too close to the other components within the housing 85, or it is possible that the toner removed from the intermediary transfer belt 61 will adhere to the two-sided adhesive tape 87, with which the vibration controlling component 86 was attached, and therefore, the two-sided adhesive tape 87 will reduce in adhesiveness, the vibration controlling component 86 is to be attached to the outward side of the housing 85. Typically, the vibration controlling component 86 is attached as far away from the origin of the low-frequency vibration, which is the area of contact between the intermediary transfer belt 61 and blade 81. As described above, the origin of the low-frequency vibration is where the blade 81 contacts the intermediary transfer belt 61 as the belt 61 is circularly moved. However, the low-frequency vibration travels through the blade support 82, pivot pin 83, blade pressing spring 84, and housing 85. Typically, therefore, the vibration controlling component 86 is placed further away from the intermediary transfer belt 61 than the housing 85. Thus, not only is it possible to highly effectively prevent the occurrence of the low-frequency vibration, but also, it is possible to afford more latitude in the positioning of the vibration controlling component 86.

Further, according to the tests, because the vibration controlling component 86 was attached to the housing 85 with the placement of viscoelastic material between vibration controlling component 86 and housing 85, the blade support 82 was allowed to vibrate without sympathizing with blade 81, being thereby enabled to dampen the low-frequency vibration. Thus, the heavier the vibration controlling component 86, the better. However, the weight of the vibration controlling component 86 is optional. That is, it may be set in consideration of the weight of the cleaning device 8 prior to the attachment of the vibration controlling component 86, based on where on the housing 85 the vibration controlling component 86 is attached, or the like factor, so that the low-frequency vibration can be satisfactorily dampened in a test such as the tests, the results of which are given in FIG. 4. Typically, even if the vibration controlling component 86 is lighter than the cleaning device 8 prior to the attachment of the vibration controlling device 86 to the housing 85, the vibration controlling component 86 is satisfactorily effective to dampen the low-frequency vibration from the blade 81. However, it may be heavier than the cleaning device 8 prior to the attachment of the vibration controlling component 86. In this embodiment, the weight of the vibration controlling component 86 is greater than that of the cleaning device 8 prior to the attachment of the vibration controlling component 86.

Figure 6:
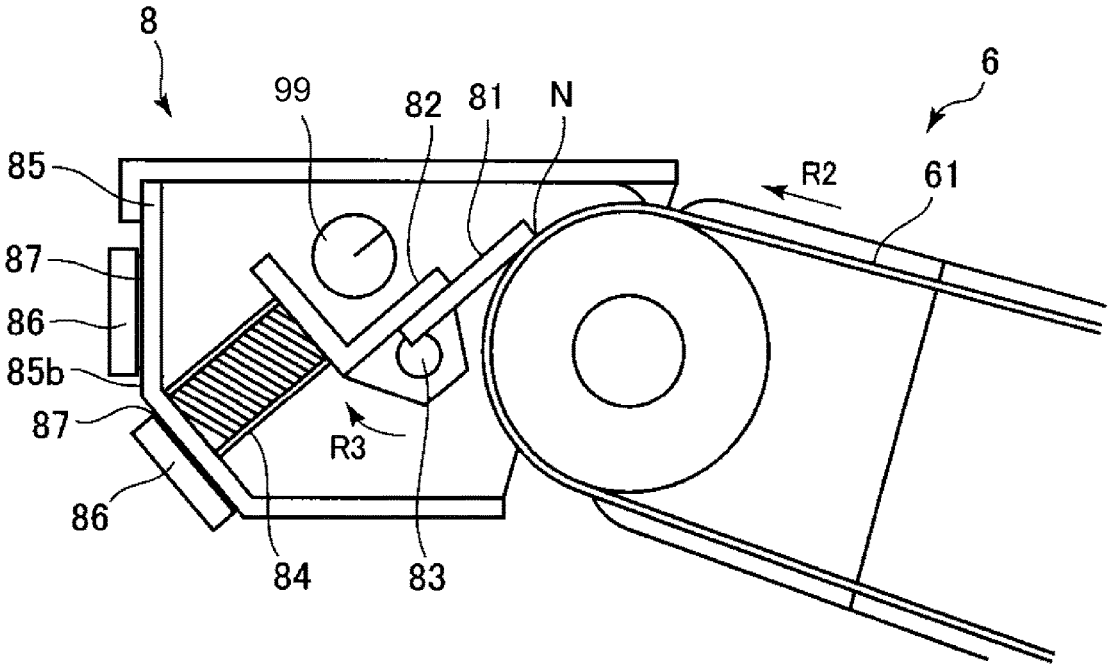
FIG. 6 is a schematic sectional view of another modified version of the cleaning device in the first embodiment, which has multiple vibration controlling components.
Figure 7:
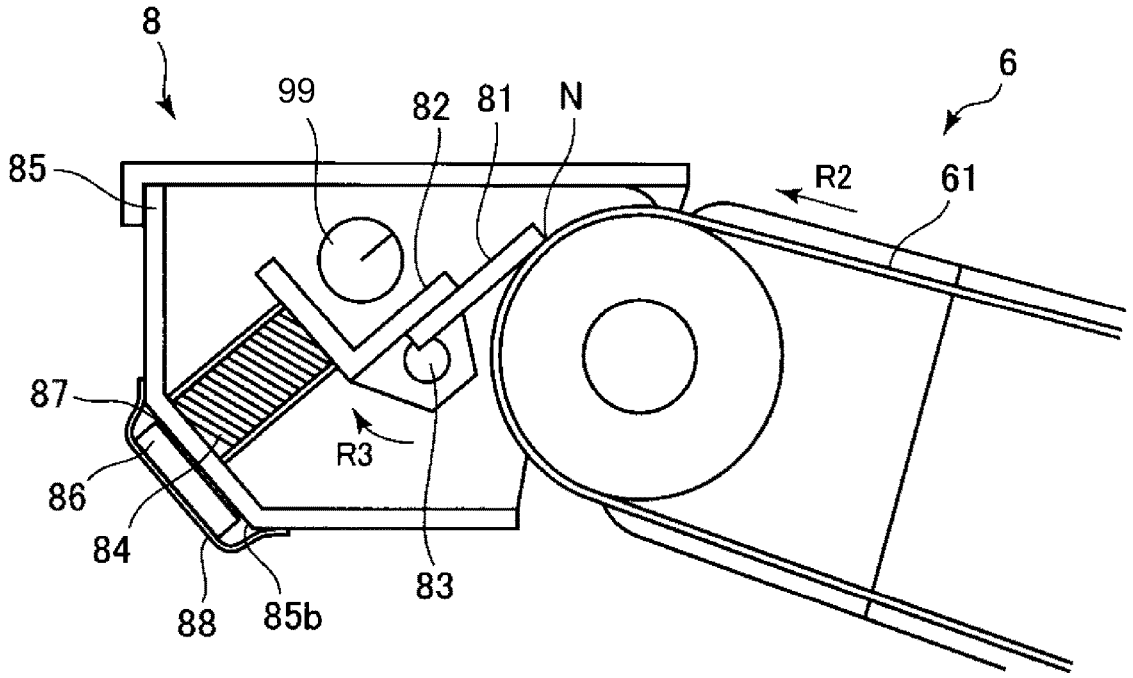
FIG. 7 is a schematic sectional view of another modified version of the cleaning device in the first embodiment, which is different from the original version in how and where the vibration controlling components are attached.

Further, referring to FIG. 6, in order to increase the ratio of the weight of the vibration controlling means relative to the weight of the cleaning device 8 prior to the attachment of the vibration controlling means, two (or more) vibration controlling components 86 may be attached to the housing 85. For example, in a case where two vibration controlling components 86 are attached to the housing 85, it is desired that the two vibration controlling components 86 are attached to two different surfaces of the housing 85, one for one, which are intersectional to each other. With two vibration controlling components 86 attached to the housing 85 as described above, the two vibration controlling components 86 vibrate in different directions, that is, the directions parallel to the surfaces to which they are attached, one for one, without sympathizing with the blade support 82. Therefore, this embodiment becomes even more effective to dampen the low-frequency vibration.

As for the size of the two-sided adhesive tape 87, it is optional as long as the vibration controlling component 86 is allowed to vibrate without sympathizing with the blade support 82 (vibration controlling component 86 is allowed to independently vibrate from housing 85). Further, in a case where the vibration controlling component 86 is attached to the housing 85 with the use of only the two-sided adhesive tape 87 as in this embodiment, it is necessary for the size of the two-sided adhesive tape 87 to be set to ensure that the vibration controlling component 86 remains firmly adhered to the housing 85. In this embodiment, the size of the two-sided adhesive tape 87 was set so that the vibration controlling component 86 covers roughly the entirety of the surface of the vibration controlling component 86, which faces the housing 85.

In this embodiment, the two-sided adhesive tape 87 was used to attach the vibration controlling component 86 to the housing 85. However, all that is necessary is for the vibration controlling component 86 to vibrate without sympathizing with the blade support 82. Thus, the vibration controlling component 86 may be attached to the housing 85 with the use of a combination of the viscoelastic material 87 of the viscoelasticity which is to be placed between the vibration controlling component 86 and housing 85, and a binding means 88 such as adhesive tape which keeps the vibration controlling component 86 held to the housing 85 by being adhered to the housing 85 in a manner to wrap around the vibration controlling component 86. In this case, the viscoelastic material 87 does not need to have the function of holding the vibration controlling component 86 to the housing 85. This example, however, is not intended to limit the present invention in scope. For example, a viscoelastic member 87 in the form of a sheet or plate of acrylic polymer may be used. The vibration controlling component 86 may be held to the housing 85 with the use of a binding means 88 after the vibration controlling component 86 is attached to the housing 85 with the use of not only the two-sided adhesive tape 87 as the viscoelastic member, which is placed between the vibration controlling component 86 and housing 85. Further, referring to part (c) of FIG. 8, a two-sided adhesive tape 87 may have the adhesive material layers 87C on both sides of the viscoelastic material layer 87A. In this case, the adhesive tape 87 is placed between the vibration controlling component 86 and housing 85 so that its two adhesive layers 87C adhere to the vibration controlling component 86 and housing 85, one for one. Also in this case, the vibration controlling component 86 may be held to the housing 85 also with the use of the binding component 88 after the attachment of the vibration controlling component 86 to the housing 85 with the use of the adhesive tape 87.

As described above, in this embodiment, the vibration controlling component 86 is attached with the use of the viscoelastic member 87 made of viscoelastic material or having viscoelasticity placed between the vibration controlling component 86 and the housing 85 of the cleaning device 8 to attach the vibration controlling component 86 to the housing 85. Thus, not only is it possible to afford the cleaning device 8 more latitude in terms of the positioning of its vibration controlling component 86, but also, to dampen the low-frequency vibration which occurs between the intermediary transfer belt 61 and blade 81, while reducing the need for a large space to be dedicated to the placement of the vibration controlling component 86. Therefore, even in a case where it is difficult to attach the vibration controlling component 86 to the blade support 82, it is possible to prevent the occurrence of the blade noise attributable to the low-frequency vibration which occurs between the intermediary transfer belt 61 and blade 81, without increasing the image forming apparatus 100 in size. That is, according to the embodiment, it is possible to prevent the occurrence of the strange noise attributable to the low-frequency vibration of the blade 81, without increasing the image forming apparatus 100 in size.

[Miscellanies]

In the foregoing, the present invention was described with reference to one of the preferred embodiments of the present invention. However, the preceding embodiment is not intended to limit the present invention in scope.

In the above-described embodiment, the cleaning device was structured so that its blade is allowed to pivotally move. However, the present invention is also applicable to any cleaning device structured so that the vibration of its blade is transmitted to the housing of the cleaning device. For example, the present invention is also applicable to a cleaning device structured so that its blade (or blade support) is fixed to the housing of the cleaning device with the use of fixing components such as small screws or adhesive. The effects of the application are the same as those obtainable by the preceding embodiment.

Further, in the above-described embodiment, the cleaning component of the cleaning device was a rubber blade, that is, an elastic component. The low-frequency vibration is likely to occur to such a cleaning device as the one in the preceding embodiment. Thus, the present invention is more effective in a case where the present invention is applied to a cleaning device such as the one in the preceding embodiment than otherwise. However, the present invention is also applicable to cleaning devices, the cleaning component of which for cleaning the moving component is not an elastic component, in order to dampen the low-frequency vibration which originates from the cleaning component. For example, the present invention is also applicable to a cleaning device, the cleaning component of which is a brush or a pad. The effects of the application of the present invention to such a cleaning device are the same as those described in the foregoing.

Moreover, in the above-described embodiment, the movable component was the intermediary transferring component. However, the preceding embodiment is not intended to limit the present invention in scope. For example, an image forming apparatus of the so-called direct transfer type employs an endless belt which is similar to the intermediary transfer belt in the preceding embodiment, as a transfer medium bearing component which bears and conveys transfer medium onto which a toner image is transferred from an image bearing component. Also in the case of an image forming apparatus of the so-called direct transfer type, toner adheres to the surface of the transfer medium bearing component during an image forming operation, during an adjustment operation, or due to paper jam or the like. Thus, an image forming apparatus of the so-called direct transfer type also employs a cleaning device which is similar to the one employed by the image forming apparatus in the preceding embodiment. Thus, the present invention is also applicable to an image forming apparatus of the so-called direct transfer type, and the application can provide the same effects as those mentioned in the foregoing description of the preceding embodiment. Further, the application of the present invention is not limited to a cleaning device, the movable component of which is an endless belt. For example, the present invention is also applicable a device, the movable component of which is an intermediary transferring component or a transfer medium bearing component of the drum type, which is made up of a frame, and a sheet suspended and tensioned by the frame. Moreover, the present invention is also applicable to a device, the movable component of which is a photosensitive component (photosensitive belt, photosensitive drum) or an electrostatically recordable dielectric component, which is in the form of a drum or an endless belt.

Further, in the above-described embodiment, the cleaning device and movable component were parts of a unit which is removably installable in the main assembly of the image forming apparatus. However, the preceding embodiment is not intended to limit the present invention in scope. That is, the present invention is also applicable to a cleaning unit which is removably installable in the main assembly of an image forming apparatus, as well as a cleaning device which is fixed to the main assembly of an image forming apparatus and cannot be easily removed or reinstalled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-244530 filed on Dec. 2, 2014, which is hereby incorporated by reference herein in its entirety.

What is claimed is:

1. An image forming apparatus comprising:

an intermediary transfer member configured to carry a toner image transferred from a photosensitive member to transfer the toner image onto a transfer material;

a cleaning member contacted to said intermediary transfer member to clean a surface of said intermediary transfer member;

a supporting member configured to support said cleaning member;

an urging member mounted to said cleaning member at one end of said urging member and configured to urge said cleaning member toward said intermediary transfer member;

a case configured to hold said supporting member so as to cover said cleaning member and said supporting member, said case including a space for containing said supporting member;

a conveying member disposed in the space, configured to convey the toner recovered by said cleaning member;

a viscoelasticity member; and a vibration controlling member configured to suppress vibration of said cleaning member, wherein said vibration controlling member is not contacted to said supporting member, and is mounted on an outer surface of said case by said viscoelasticity member.

2. An apparatus according to claim 1, wherein said viscoelasticity member includes a base material and a viscoelastic layer thereon.

3. An apparatus according to claim 1, wherein said case is rotatable relative to said intermediary transfer member about a rotational axis.

4. An apparatus according to claim 1, wherein said vibration controlling member includes a plate-like member of metal.

5. An apparatus according to claim 1, wherein said vibration controlling member is disposed at a position further from said intermediary transfer member than said case.

6. An apparatus according to claim 1, wherein said vibration controlling member is mounted at a position relatively remote from said intermediary transfer member.

7. An apparatus according to claim 1, wherein said vibration controlling member includes a first vibration controlling element and a second vibration controlling element.

8. An apparatus according to claim 7, wherein said first vibration controlling element and said second vibration controlling element are mounted on different surfaces of said case which are crossed with each other.

9. An apparatus according to claim 1, wherein said vibration controlling member is opposed to said urging member across said case.

10. An apparatus according to claim 1, wherein said vibration controlling member is mounted to said case by a confining member with said viscoelasticity member sandwiched between said case and said vibration controlling member.

11. An apparatus according to claim 1, wherein said cleaning member includes a blade of elastic material.

12. An apparatus according to claim 11, wherein said blade is rotatably held by said case.

13. An apparatus according to claim 1, wherein said intermediary transfer member includes an endless belt.

14. An apparatus according to claim 1, wherein said viscoelasticity member is a double-coated tape.

* * * * *